US008418468B2

(12) United States Patent
McMahan et al.

(10) Patent No.: US 8,418,468 B2
(45) Date of Patent: Apr. 16, 2013

(54) SEGMENTED ANNULAR RING-MANIFOLD QUATERNARY FUEL DISTRIBUTOR

(75) Inventors: Kevin Weston McMahan, Greer, SC (US); Almaz Valeev, Kazan (RU); Chunyang Wu, Greer, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/754,813

(22) Filed: Apr. 6, 2010

(65) Prior Publication Data

US 2011/0239652 A1 Oct. 6, 2011

(51) Int. Cl.
*F02C 1/00* (2006.01)

(52) U.S. Cl.
USPC ..... 60/739

(58) Field of Classification Search ..... 60/739, 60/740

See application file for complete search history.

(56) References Cited

U.S. PATENT DOCUMENTS

| | | | | | |
|---|---|---|---|---|---|
| 2,552,851 | A | * | 5/1951 | Gist, Jr. | 60/738 |
| 2,720,081 | A | * | 10/1955 | Tutherly | 60/737 |
| 2,862,359 | A | * | 12/1958 | Spears, Jr. | 60/739 |
| 2,920,449 | A | * | 1/1960 | Johnson et al. | 60/739 |
| 3,102,392 | A | * | 9/1963 | Bauger et al. | 60/765 |
| 3,768,251 | A | | 10/1973 | Camboulives et al. | |
| 4,170,111 | A | | 10/1979 | Lewis et al. | |
| 4,499,735 | A | | 2/1985 | Moore et al. | |
| 4,862,693 | A | | 9/1989 | Batakis et al. | |
| 5,168,698 | A | * | 12/1992 | Peterson et al. | 60/779 |
| 5,231,833 | A | * | 8/1993 | MacLean et al. | 60/734 |
| 5,259,184 | A | | 11/1993 | Borkowicz et al. | |
| 5,321,949 | A | * | 6/1994 | Napoli et al. | 60/739 |
| 5,359,847 | A | | 11/1994 | Pillsbury et al. | |
| 5,361,586 | A | | 11/1994 | McWhirter et al. | |
| 5,901,555 | A | * | 5/1999 | Mandai et al. | 60/747 |
| 5,937,653 | A | | 8/1999 | Alary et al. | |
| 5,983,642 | A | | 11/1999 | Parker et al. | |
| 6,109,038 | A | | 8/2000 | Sharifi et al. | |
| 6,282,904 | B1 | | 9/2001 | Kraft et al. | |
| 6,397,602 | B2 | | 6/2002 | Vandervort et al. | |
| 6,446,439 | B1 | | 9/2002 | Kraft et al. | |
| 6,513,334 | B2 | * | 2/2003 | Varney | 60/776 |
| 7,080,515 | B2 | * | 7/2006 | Wasif et al. | 60/737 |
| 7,137,256 | B1 | | 11/2006 | Stuttaford et al. | |
| 7,249,461 | B2 | | 7/2007 | Moraes | |
| 7,966,820 | B2 | | 6/2011 | Romoser | |
| 2002/0020173 | A1 | * | 2/2002 | Varney | 60/737 |
| 2002/0078690 | A1 | | 6/2002 | Stuttaford et al. | |
| 2002/0174657 | A1 | | 11/2002 | Rice et al. | |
| 2011/0061395 | A1 | * | 3/2011 | Kendrick | 60/772 |

OTHER PUBLICATIONS

Davis et al., "Dry Low NOx Combustion Systems for GE Heavy-Duty Gas Turbines", GER-3568G, Oct. 2000, pp. 1-26.

Final Office Action dated Nov. 23, 2011 for U.S. Appl. No. 12/754,803.

* cited by examiner

*Primary Examiner* — Gerald Sung
(74) *Attorney, Agent, or Firm* — Cantor Colburn LLP

(57) ABSTRACT

A combustor section is provided and includes a segmented annular manifold mounted upstream from a fuel nozzle support in a section of a passage through which an oxidizer flows, each segment of the manifold being substantially axially aligned and including a body to accommodate fuel internally that is formed to define injection holes through which the fuel is injected into the passage through which the oxidizer flows upstream of the fuel nozzle support.

29 Claims, 5 Drawing Sheets

SEGMENTED ANNULAR RING-MANIFOLD QUATERNARY FUEL DISTRIBUTOR

CROSS REFERENCE TO RELATED APPLICATIONS

The present application is hereby cross-referenced with co-pending application entitled "Annular Ring-Manifold Quaternary Fuel Distributor," the entire contents of which are incorporated herein by reference.

BACKGROUND OF THE INVENTION

The subject matter disclosed herein relates to gas turbine combustors, and particularly to an annular ring-manifold quaternary fuel distributor, which is used to mitigate combustor instability, to provide better fuel/air mixing and improve flame holding margin of downstream fuel nozzles by accommodating up to 30%, by mass, of total combustor fuel.

Existing quaternary fuel pegs of a combustor are installed through the flow sleeve casing inner wall of, for example, combustors of gas turbine engines and are located in the annulus between the flow sleeve and cap barrel, which are upstream of combustor fuel nozzles. Their main function is to inject fuel into the flow of air or a fuel/air mixture and to mitigate combustion dynamics in and through the combustor during combustion operations.

The existing quaternary peg design is susceptible, however, to instances of flame-holding, which refers to the phenomena of unexpected flame occurrence immediately downstream of the quaternary pegs within combustors. Flame-holding can lead to damage to combustor hardware. The existing design also tends to generate relatively unsatisfactory quaternary fuel air mixing, which limits the capability to accommodate high quaternary fuel mass fraction, leading to unsatisfactory or limited quaternary fuel-air pre-mixing upstream combustor fuel nozzles.

BRIEF DESCRIPTION OF THE INVENTION

According to one aspect of the invention, a combustor section is provided and includes a segmented annular manifold mounted upstream from a fuel nozzle support in a section of a passage through which an oxidizer flows, each segment of the manifold being substantially axially aligned and including a body to accommodate fuel internally that is formed to define injection holes through which the fuel is injected into the passage through which the oxidizer flows upstream of the fuel nozzle support.

According to another aspect of the invention, a combustor is provided and includes a casing, and a cap assembly disposed within the casing to define an annular passage along which oxidizer flows upstream from a fuel nozzle support, the annular fuel manifold including a segmented annular body, each body segment being substantially axially aligned, formed to accommodate fuel therein and formed to define fuel injection holes by which the fuel is injected into a section of the passage upstream from the fuel nozzle support.

According to yet another aspect of the invention, an annular fuel manifold of a combustor is provided and includes a casing, and a cap assembly disposed within the casing to define an annular passage along which oxidizer flows upstream from a fuel nozzle support, the annular fuel manifold including a segmented annular body, each body segment being substantially axially aligned, formed to accommodate fuel therein and formed to define fuel injection holes by which the fuel is injected into a section of the passage upstream from the fuel nozzle support.

According to yet another aspect of the invention, a combustor section is provided and includes a segmented manifold mounted upstream from a fuel nozzle support in a section of a passage through which an oxidizer flows, each segment of the manifold being substantially axially aligned and including a body to accommodate fuel internally, each of the bodies having a shape reflective of an axial shape of the passage section and being formed to define injection holes through which the fuel is injected into the passage through which the oxidizer flows upstream of the fuel nozzle support.

According to yet another aspect of the invention, a combustor section is provided and includes a casing, a cap assembly, having a fuel nozzle support formed therein, the cap assembly being disposed within the casing to define a passage between the casing and the cap assembly along which oxidizer flows upstream from the fuel nozzle support and a segmented manifold mounted within a section of the passage at which the oxidizer flows upstream from the fuel nozzle support, each of the segments being substantially axially aligned and including a body in which fuel is accommodated, each of the bodies having a shape reflective of an axial shape of the passage section and injection holes through which the fuel is injected into the passage section.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

In accordance with aspects of the invention, one or more concentric annular ring-shaped manifolds may be installed within, for example, a combustor of a gas turbine engine, upstream of combustor fuel nozzles, for promoting and structurally supporting substantially uniform distribution of quaternary fuel injection locations to thus improve fuel and air mixing. Such manifolds may be able to handle relatively large quaternary fuel mass fractions (i.e., about >30% of total system fuel on a mass basis), reduce flame-holding occurrence downstream including the quaternary fuel injection region and areas near the downstream combustor fuel nozzles, and may contribute to reducing NOx emissions and combustion instabilities.

Figure 1:
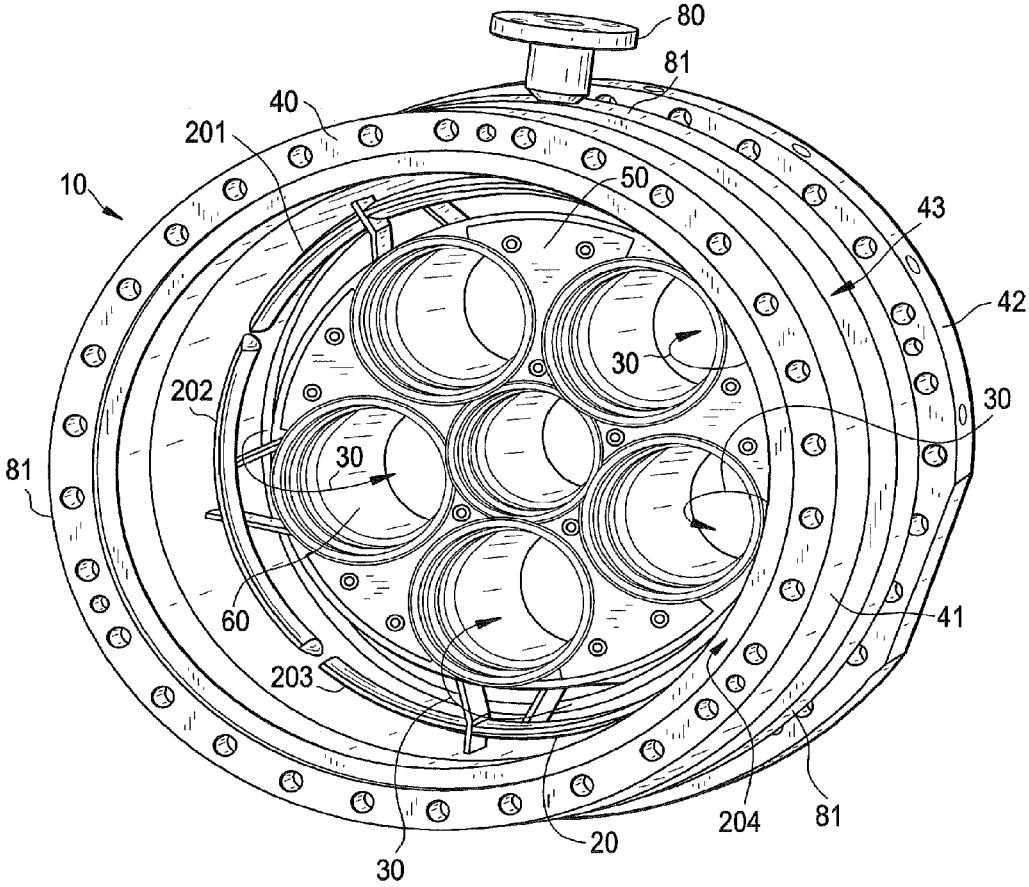
FIG. 1 is a perspective downstream view of a combustor section including a casing and a cap assembly with an end cover removed for clarity.

With reference to FIG. 1, a combustor section 10 is provided and includes an annular manifold 20 that is segmented into body segments 201, 202, 203 and 204. Each body segment 201, 202, 203 and 204 is mounted within an annular passage 30, which is defined between a casing 40 and a cap assembly 50. The casing 40 includes first and second casing flanges 41 and 42 and a quaternary fuel distribution manifold 43. The quaternary fuel distribution manifold 43 is axially interposed between the first and second casing flanges 41 and 42. The cap assembly 50 is formed with a plurality of fuel nozzle supports 60 in which combustor fuel nozzles may be located. Combustible material (hereinafter referred to as an "oxidizer") flows through the annular passage 30 upstream from the fuel nozzle supports 60.

In accordance with embodiments, the body segments 201, 202, 203 and 204 are substantially axially aligned with one another although it is understood that this is merely exemplary and that body segments may be axially staggered with respect to one another as well. The annular manifold 20 may be segmented into two or more body segments, with each having a substantially uniform circumferential length and each one being separated from an adjacent one by substantially uniform spacing. Again, it is understood that this configuration is merely exemplary and that longer and shorter body segments may be employed and that they may be separated from one another by uniform or variable length spaces.

Figure 2:
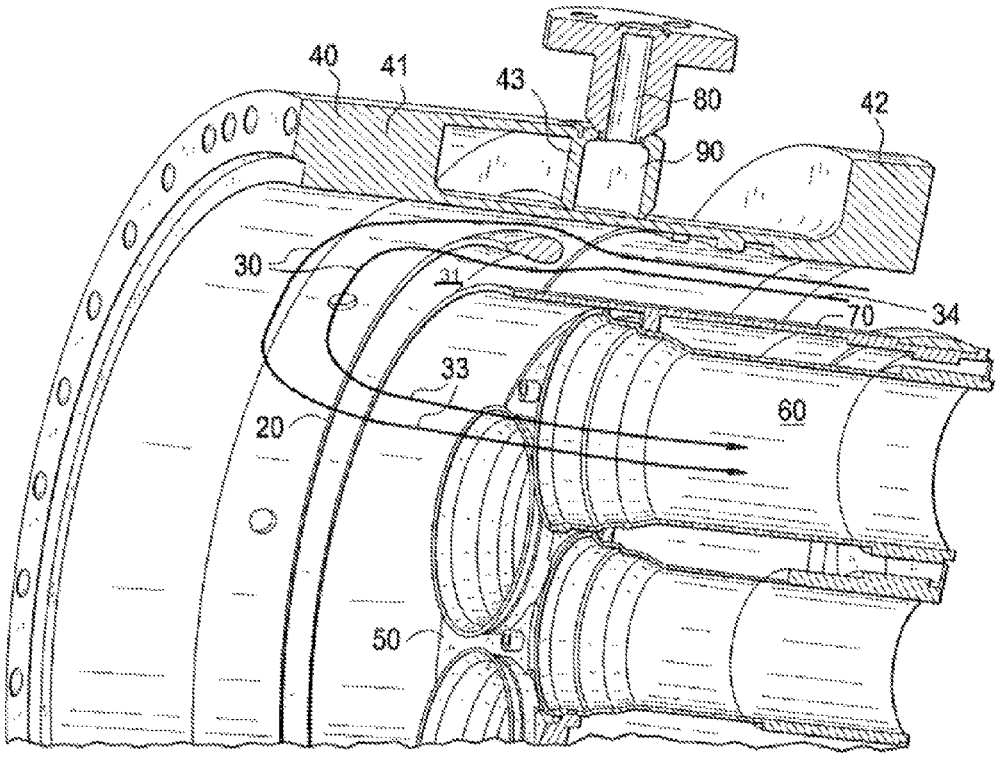
FIG. 2 is an enlarged perspective view of a portion of the combustor of FIG. 1, highlighting a quaternary fuel distribution manifold, a segmented manifold, and the annulus formed by the casing and the cap assembly.
Figure 3:
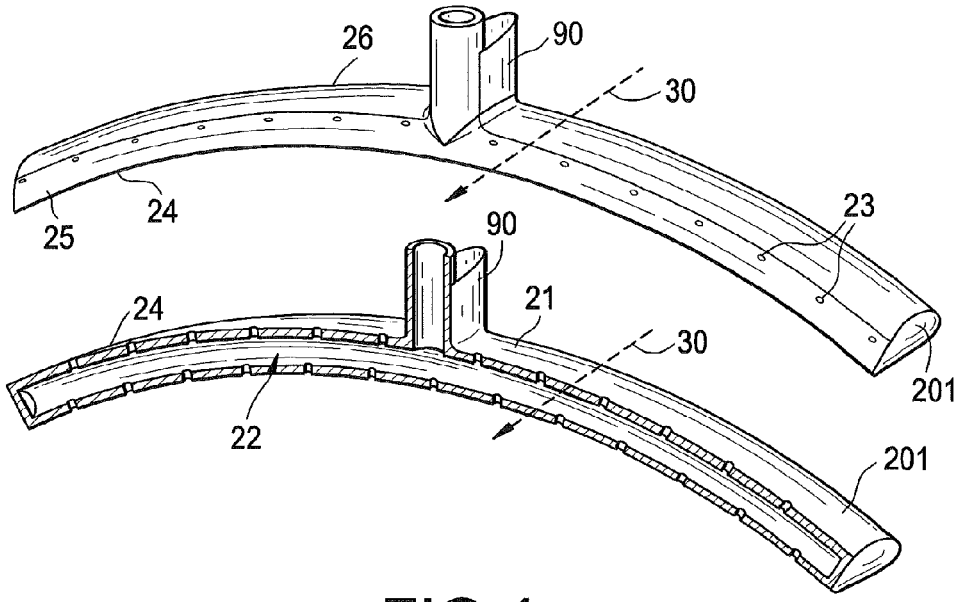
FIG. 3 is an enlarged perspective view of a body of a segmented annular fuel manifold and an interior thereof.
Figure 4:
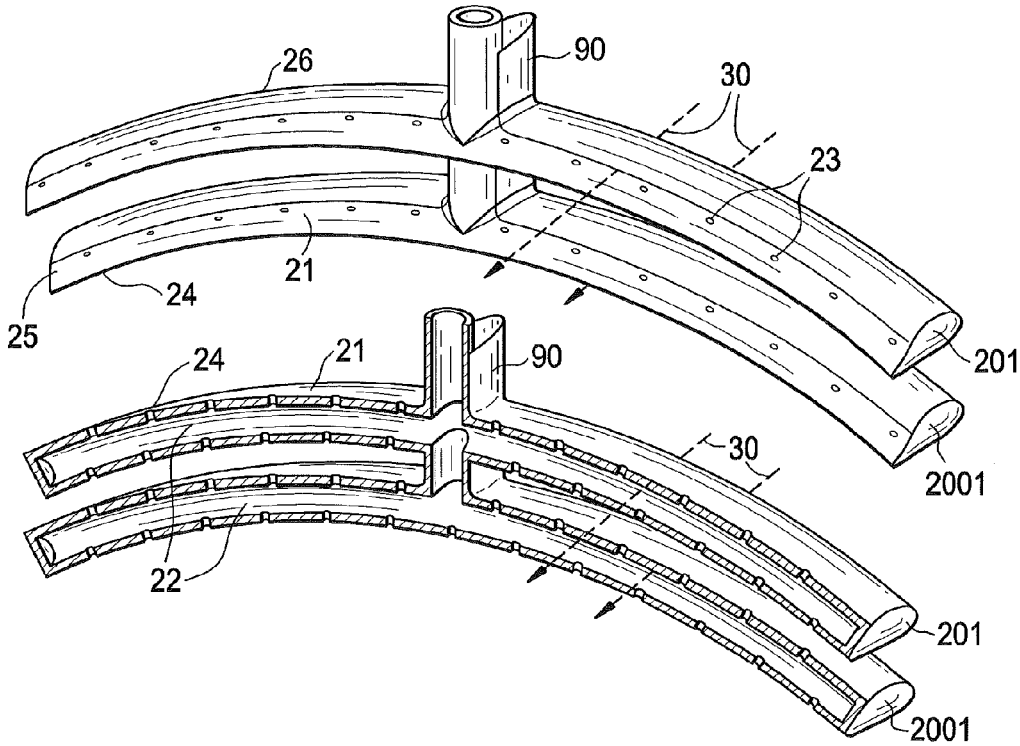
FIG. 4 is an enlarged perspective view of a body of a set of segmented annular fuel manifolds and interiors thereof.

With reference to FIGS. 2-4, each of the body segments 201, 202, 203 and 204 includes an annular body 21 that may, in some cases, be arranged to perimetrically surround the cap assembly 50. In this way, each of the body segments 201, 202, 203 and 204 generates turbulence within the passage 30 and additionally provides for fuel injection geometries that promote substantially uniform fuel and air mixing in the annulus of the combustor section 10 upstream from the fuel nozzle supports 60.

The annular body 21 of each body segment 201, 202, 203 and 204 includes a segment of a ring-shaped casing 24 that is formed to define an interior therein with first and second opposing sides 25 and 26, at least one of which is tapered in accordance with a predominant direction of incoming fuel to reduce the trailing edge flow separation (recirculation) and, in some cases, so as to thereby reduce a likelihood of an occurrence of reduce local flame-holding. The interior serves as a fuel accommodating space 22, which is sufficiently large enough such that the sum total volume of the space 22 of each of the body segments 201, 202, 203 and 204 accommodates a predefined quantity of fuel. In some cases, this quantity may be up to about 30% by mass of total combustor fuel with an amount accommodated within each of the body segments 201, 202, 203 and 204 being one of fixed and actively controlled. Each annular body 21 is further formed to define injection holes 23 through which fuel is injected from the corresponding fuel accommodating space 22 and into a section 31 of the passage 30. The injection holes 23 are perimetrically arrayed around each body segment 201, 202, 203 and 204 and may be, therefore, able to substantially uniformly distribute quaternary fuel into the passage 30.

The taper of the casing 24 is defined in a direction corresponding to a predominant flow direction of the oxidizer through the passage 30 at the section 31. Thus, a relatively blunt side 26 faces the oncoming flow with the tapered side 25 pointing downstream. The fuel injection holes 23 may be arrayed at various locations on the casing 24 and with varying non-uniform or substantially uniform spacing from one another. In accordance with further embodiments, the fuel injection holes 23 may be formed proximate to the tapered side 25 and on radially inward and radially outward facing surfaces such that the fuel is injected into the section 31 in substantially radially inward and radially outward directions.

In accordance with still further embodiments, the fuel injection holes 23 may be disposed at radial maximum and radial minimum sections of the annular body 21.

The section 31 of the passage 30 is defined as a portion of the passage 30 at which the oxidizer flows upstream from the fuel nozzle supports 60. The section 31 may be further defined as a portion of the passage 30 at which the oxidizer flows at a relatively high local velocity measured relative to relatively low but non-zero flow velocities at other sections of the passage 30. In accordance with embodiments, the high flow velocities may be caused by various factors including, but not limited to, the width of the passage 30 being relatively narrow in some areas as compared with other areas, other aerodynamic considerations and the possible presence of additional flows.

In accordance with embodiments, the section 31 may be radially interposed between the casing 40 and the cap assembly 50. In accordance with further embodiments, the cap assembly 50 may include a baffle 70, which extends axially from an edge of the cap assembly 50. In these embodiments, the section 31 may be radially interposed between the casing 40 and the baffle 70.

The passage 30 is defined with a first leg 33 that is radially aligned with the fuel nozzle support 60 and a second leg 34 that is positioned radially outward of the fuel nozzle support 60. The second leg 34 is upstream from the first leg 33 such that the passage 30 is generally hooked inwardly with the oxidizer flowing in opposite directions along the first and second legs 33 and 34. The section 31 of the passage 30, at which the oxidizer flows at the relatively high local velocity, may be disposed along at least one of the first leg 33 and the second leg 34 or within a region between the legs 33 and 34 where the passage 30 is hooked.

As shown in FIGS. 3 and 4, each of the body segments 201, 202, 203 and 204 may be singular or plural in number. Where any of the body segments 201, 202, 203 and 204 are plural (see FIG. 4), in an example, at least one or more body segment 201 may be disposed radially outwardly of another body segment 2001. In accordance with embodiments, the exemplary plural body segments 201 and 2001 may be substantially coaxial, although it is understood that this is not necessary and that the body segments 201 and 2001 may be axially staggered. Also, the one or more body segments 201, 2001 may be fueled or otherwise supplied independently of one another with differing fuels, diluents and/or steam.

Referring to FIGS. 1-4, the combustor section 10 may further include at least one fuel source, such as one or more fuel line flanges 80, which are disposed radially outside of an exterior surface of the quaternary fuel distribution manifold 43. The fuel line flanges 80 may be attached to sections 81 of the quaternary fuel distribution manifold 43. Also, one or more substantially radially oriented supply lines 90 may be formed as component(s) of the quaternary fuel distribution manifold 43. Each supply line 90 may be coupled to each of the fuel line flanges 80 and each of the body segments 201, 202, 203 and 204 to thereby supply a single type of fuel or multiple types of fuels jointly or separately from the fuel line flanges 80 to the body segments 201, 202, 203 and 204 and, more particularly, the respective fuel accommodating spaces 22 therein. The quaternary fuel distribution manifold 43 and the body segments 201, 202, 203 and 204 may be substantially axially aligned with one another or, in other embodiments, axially staggered with respect to one another.

Figure 5:
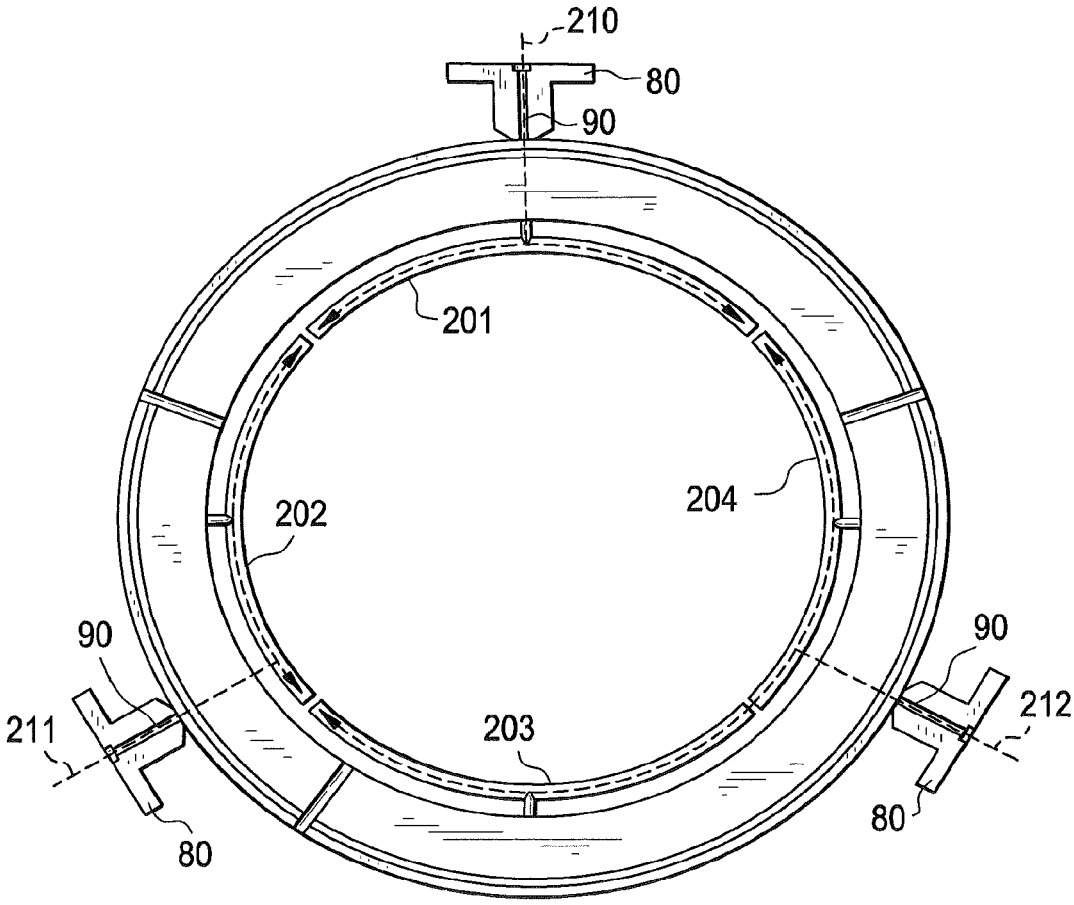
FIG. 5 is an axial view of fuel transmission lines coupled to the segmented annular fuel manifolds.

As shown in FIG. 5, the supply lines 90 may be fed from various fuel circuits to provide for flexible combustor. The supply lines 90 may be coupled to each of the fuel line flanges 80 and to each of the body segments 201, 202, 203 and 204 to thereby form fuel transmission pathways 210, 211 and 212.

As an example, fuel transmission pathways 210 and 211 may be defined from fuel line flanges 80 along supply lines 90 to body segments 201 and 202, respectively. In this case, the fuel line flange 80, components of the supply line 90 and the corresponding body segments 201, 202 would be generally circumferentially aligned with one another although this is not required. As an alternate example, the fuel transmission pathway 212 may deliver fuel to both body segments 203 and 204.

Figure 6:
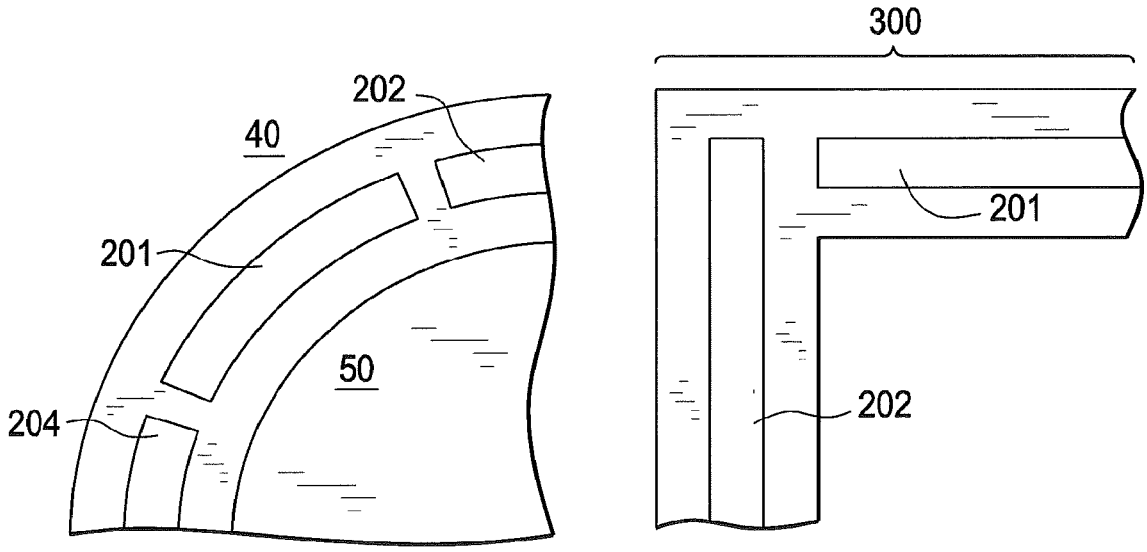
FIG. 6 includes a pair of schematic downstream views of a combustor section.

With reference to FIG. 6 and, in accordance with another aspect of the invention, each of the body segments 201, 202, 203 and 204 may have a shape that is reflective of an axial shape of the passage section. That is, where the passage section is annular, the shapes of each of the body segments are also annular. By contrast, where the passage section has an angular or rectangular cross-sectional shape 300, the shapes of each of the body segments also have an angular or rectangular cross sectional shape.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A combustor section, comprising:

a segmented annular quaternary fuel manifold mounted at a location defined axially upstream from a fuel nozzle support relative to a combustor centerline axis, the segmented annular manifold being mounted in a section of a passage through which an oxidizer flows, the passage being defined such that the oxidizer flows through the passage in a reverse direction radially outwardly of the fuel nozzle support and in a forward direction radially aligned with the fuel nozzle support, the segmented annular manifold being located in a section of the passage in which the oxidizer flows in the reverse direction at a local velocity that exceeds oxidizer flow velocities in other sections of the passage, each segment of the manifold being substantially axially aligned with one another and including a body to accommodate fuel internally, the body being formed to define injection holes through which the fuel is injected into the passage through which the oxidizer flows, the fuel injection occurring axially upstream of the fuel nozzle support.

2. The combustor section according to claim 1, further comprising a casing and a cap assembly, the casing surrounding the segmented annular manifold and the cap assembly being located radially inwardly of the casing and including the fuel nozzle support, which is provided as one of a plurality of fuel nozzle supports, wherein the section of the passage through which an oxidizer flows is radially interposed between the casing and the cap assembly of a combustor.

3. The combustor section according to claim 2, further comprising an annular baffle extending axially from the cap assembly to surround the plurality of fuel nozzle supports, wherein the section of the passage in which the segmented annular manifold is located is radially interposed between the casing and the baffle.

4. The combustor section according to claim 1, wherein each segment defines an internal volume, and wherein a sum total volume of the segmented manifold accommodates up to about 30% by mass of available fuel of the combustor.

5. The combustor section according to claim 4, wherein an amount of the available fuel accommodated within each segment is one of fixed and actively controlled.

6. The combustor section according to claim 1, wherein the injection holes are perimetrically arrayed at each segment.

7. The combustor section according to claim 1, wherein each of the bodies comprises a segmented ring-shaped casing having first and second opposing sides, at least one of which is tapered.

8. The combustor section according to claim 1, wherein the segmented annular manifold comprises one or more segments that is plural in number such that, for each of the plural manifold segments, one segment is radially outward of another one of the plural manifold segments.

9. The combustor section according to claim 8, wherein the one or more of the segments are fueled independently with differing fuels, diluents, and/or steam.

10. The combustor section according to claim 1, further comprising:

at least one fuel source; and at least one supply line coupled to the at least one fuel source by which fuel is supplied from the fuel source to at least one of the segments of the manifold.

11. The combustor section according to claim 1, wherein the axial location upstream from the fuel nozzle support is defined as an axial location that is axially interposed between an axial location of the fuel nozzle support and an axial location at which the air and/or the fuel/air mixture changes from flowing in the reverse direction to flowing in the forward direction.

12. A combustor section, comprising:

a casing;

a cap assembly, having a fuel nozzle support formed therein, the cap assembly being disposed within the casing to define an annular passage between the casing and the cap assembly through which oxidizer flows in a reverse direction, then in a radially inward direction and then in a forward direction opposite the reverse direction upstream from the fuel nozzle support; and a segmented annular quaternary fuel manifold mounted within a section of the passage at which the oxidizer flows in the reverse direction, the segmented annular manifold being mounted at a location defined axially upstream from the fuel nozzle support relative to a combustor centerline axis, each of the segments being substantially axially aligned with one another and including a body in which fuel is accommodated and injection holes through which the fuel is injected into the passage section.

13. The combustor section according to claim 12, wherein the casing comprises:

first and second flanges; and a quaternary fuel distribution manifold axially interposed between the first and second flanges and substantially axially aligned with the segmented annular manifold, the quaternary fuel distribution manifold being configured to supply fuel to the segmented annular manifold.

14. The combustor section according to claim 13, further comprising at least one or more fuel line flanges, wherein each fuel line flange supplies to one or more of the segments a same or different fuel as another fuel line flange.

15. An annular fuel manifold of a combustor, the combustor including a casing; and a cap assembly disposed within the casing to define an annular passage through which oxidizer flows in a reverse direction, then in a radially inward direction and then in a forward direction opposite the reverse direction upstream from a fuel nozzle support, the annular fuel manifold comprising:

a segmented annular body, each body segment being substantially axially aligned with one another, formed to accommodate fuel therein, and formed to define fuel injection holes by which the fuel is injected into a section of the passage at which the oxidizer flows in the reverse direction at a location defined axially upstream from the fuel nozzle support relative to a combustor centerline axis.

16. The annular fuel manifold according to claim 15, wherein the segmented annular body is segmented into two or more body segments having substantially uniform circumferential lengths and being separated from one another by substantially uniform spacing.

17. The annular fuel manifold according to claim 15, wherein each body segment is coupled to a same or different fuel source as another of the body segments.

18. The annular fuel manifold according to claim 15, wherein the segmented annular body is tapered.

19. The annular fuel manifold according to claim 15, wherein the fuel injection holes are disposed at a downstream portion of the segmented annular body.

20. The annular fuel manifold according to claim 15, wherein the fuel injection holes are arrayed with at least one of substantially uniform and non-uniform spacing along the segmented annular body, and wherein the fuel is injected in radially inward and radially outward directions relative to a combustor centerline axis.

21. The annular fuel manifold according to claim 15, wherein multiple segmented annular fuel manifolds are provided in a gas turbine engine.

22. A combustor section, comprising:

a segmented manifold configured for quaternary fuel injection into a combustor, the segmented manifold being mounted at a location defined axially upstream from a fuel nozzle support relative to a combustor centerline axis in a section of a passage through which an oxidizer flows, the passage being defined such that the oxidizer flows through the passage in a reverse direction radially outwardly of the fuel nozzle support and in a forward direction radially aligned with the fuel nozzle support each segment of the manifold being substantially axially aligned with one another and including a body to accommodate fuel internally, the bodies together defining the segmented manifold having a shape similar to a shape of the passage section at an axial location of the body and wherein each body is formed to define injection holes through which the fuel is injected into the passage through which the oxidizer flows, the fuel injection occurring axially upstream of the fuel nozzle support.

23. The combustor section according to claim 22, wherein the passage section is annular and the shape of the segmented manifold is annular.

24. The combustor section according to claim 22, wherein the passage section and the shape of each of the bodies in the segmented manifold are angular.

25. The combustor section according to claim 22, wherein the passage section and the shape of each of the bodies in the segmented manifold are rectangular.

26. A combustor section, comprising:

a casing;

a cap assembly, having a fuel nozzle support formed therein, the cap assembly being disposed within the casing to define a passage between the casing and the cap assembly through which oxidizer flows upstream from the fuel nozzle support, the oxidizer flows through the passage in a reverse direction radially outward of the fuel nozzle support and in a forward direction radially aligned with the fuel nozzle support; and a segmented manifold mounted within a section of the passage at which the oxidizer flows, the segmented manifold being mounted at a location defined axially upstream from the fuel nozzle support relative to a combustor centerline axis, each of the segments being substantially axially aligned with one another and including a body in which fuel is accommodated, the bodies together defining a segmented manifold having a shape similar to a shape of the passage section at an axial location of the body and each body defining injection holes through which the fuel is injected into the passage section, the fuel injection occurring axially upstream of the fuel nozzle support.

27. The combustor section according to claim 26, wherein the passage section is annular and the shape of the segmented manifold is annular.

28. The combustor section according to claim 26, wherein the passage section and the shape of each of the bodies in the segmented manifold are angular.

29. The combustor section according to claim 26, wherein the passage section and the shape of each of the bodies in the segmented manifold are rectangular.

* * * * *